United States Patent [19]

Perez

[11] 4,285,474

[45] Aug. 25, 1981

[54] TOILET PAPER DISPENSER WITH BIASING MEANS FOR RESTRAINING THE UNWINDING OF THE PAPER

[76] Inventor: Michael A. Perez, 5825 Glenis St., Taylor, Mich. 48180

[21] Appl. No.: 134,377

[22] Filed: Mar. 27, 1980

[51] Int. Cl.[3] ..... B65H 19/00

[52] U.S. Cl. ..... 242/55.2; 242/55.53; 242/156.1

[58] Field of Search ..... 242/55.2, 55.53, 75.4, 242/156.1; 312/40

[56] References Cited

U.S. PATENT DOCUMENTS

| | | | |
|---|---|---|---|
| 1,614,497 | 1/1927 | Simoneau | 242/156.1 |
| 2,253,664 | 8/1941 | Vigo | 242/55.53 |
| 2,948,574 | 8/1960 | Brown | 242/55.53 |
| 3,037,718 | 6/1962 | Pettit | 242/55.53 |
| 3,516,615 | 6/1970 | Wickenberg | 242/55.2 |

FOREIGN PATENT DOCUMENTS

| | | | |
|---|---|---|---|
| 169024 | 10/1959 | Sweden | 242/55.53 |

*Primary Examiner*—Edward J. McCarthy

*Attorney, Agent, or Firm*—Cullen, Sloman, Cantor, Grauer, Scott & Rutherford

[57] ABSTRACT

In combination with a toilet paper dispenser having a base mountable upon a wall and a pair of opposed trunnion arms removably mounting a dowel which loosely journals a roll of toilet paper having a lead sheet. The improvement comprises in combination therewith a biasing means for restraining unwinding of the roll, including a cover projecting from the wall and overlying the roll. A mount strip of resilient material is secured to the cover and includes a depending hinge secured to the wall. A resilient friction tab projects from the mount strip and resiliently and tangentially and yieldably bears against the roll.

11 Claims, 3 Drawing Figures

TOILET PAPER DISPENSER WITH BIASING MEANS FOR RESTRAINING THE UNWINDING OF THE PAPER

BACKGROUND OF THE INVENTION

Heretofore there has existed the problem in the mounting of a roll of toilet paper upon a bracket dispenser and of providing some means for restraining the roll against unlimited unwinding. In the environment of a dispenser having a base mountable upon a wall and a pair of opposed trunnion arms removably mounting a dowel which loosely journals a roll of toilet paper having a lead sheet, since the roll is loosely mounted upon the dowel there is the need for some means for restraining the roll during unwinding thereof In the prior art it has been known to frictionally mount the roll of toilet paper upon the dowel and in turn frictionally and restrainingly mount the dowel within the dispenser bracket such that there is a bias against free rotation of the dowel itself.

Illustrative of this in the prior art are the following U.S. Pat. Nos.

| | | | |
|---|---|---|---|
| 1,557,700 | Jaderlund | October 20, 1925 | Paper-Roll Holder |
| 2,571,321 | Wettley | October 16, 1951 | Auxiliary Core |
| 2,889,122 | McConnell | June 2, 1959 | Tissue Roll Holder |

Further illustrative in the prior art of devices for restraining the unwinding of a roll of material, particularly by usage of restraint or biasing device against the roll holder and with the roll normally mounted snuggly upon the roll holder are the following further U.S. Pat. Nos.

| | | | |
|---|---|---|---|
| 445,265 | Ray | January 27, 1891 | Inking Ribbon Spool For Typewriting Machines |
| 525,916 | Merriman | September 11, 1894 | Attachment for Typewriting Machines |
| 613,178 | Unz | October 25, 1898 | Type Writer |
| 1,431,834 | Mohr | October 10, 1922 | Manuscript Holder |
| 1,858,371 | Lutz | May 17, 1932 | Gold Leaf Laying Device |
| 1,955,489 | Duncan | April 17, 1934 | Spindle and Spindle Receptacle |
| 2,916,226 | McGraw | December 8, 1959 | Winding Arbor |
| 3,170,652 | Kennedy | February 23, 1965 | Adjustable Tension Roll Holder |
| 3,439,881 | Ulmschneider | April 22, 1969 | One-Piece Molded Spool, etc. |
| 3,480,222 | Goodman | November 25, 1969 | Photocopy Apparatus Having Roll Sheet Material Support Means |
| 3,496,909 | Bennett | February 24, 1970 | Dry Wall Tape Dispenser |

Prior art efforts to restrain the unwinding of a spool of strip material were primarily directed therefore to means for restraining rotation of the spool support in various ways.

SUMMARY OF THE INVENTION

It is an important feature of the present invention that in conjunction with a toilet paper dispenser having a base mountable upon a wall and a pair of opposed trunnion arms removably mounting a dowel which loosely journals and supports a roll of toilet paper having a lead sheet, there is provided in combination therewith a biasing means which restrains unwinding of the roll itself, and wherein the restraining means frictionally and yieldably engages the roll tangentially during unwinding thereof.

It is a further feature of the present invention to provide in conjunction with said such dispenser a cover which overlies the roll of toilet paper. A biasing means is employed for restraining unwinding of the roll which includes a cover projecting from the wall which overlies and partly encloses the roll and has front and rear edges. An elongated mount strip of resilient material is secured to the cover at its rear edge and includes an elongated depending hinge strip flexibly connected to and depending from the mount strip and secured to the wall or to the bracket. A friction tab is arranged on and flexibly and resiliently connected to the mount strip and extends angularly and forwardly downward and is adapted to tangentially and yieldably engage the roll, thereby restraining the roll and lead sheet for limited and controlled unwinding movements.

A further feature includes the construction of the mount strip including its hinge strip and friction tab of a resilient material such that as the roll unwinds and becomes reduced in diameter, friction tab yieldably follows and cooperatively and retainingly engages the roll tangentially thereof until the roll is fully unwound, and during that period limits and controls unwinding of the sheet or strip therefrom.

These and other objects will be seen from the following specification and claims in conjunction with the appended drawing.

THE DRAWING

It will be understood that the above drawing illustrates one embodiment of the invention for illustration, and that other embodiments are contemplated within the scope of the claims hereafter set forth.

DETAILED DESCRIPTION OF AN EMBODIMENT OF THE INVENTION

Figure 3:
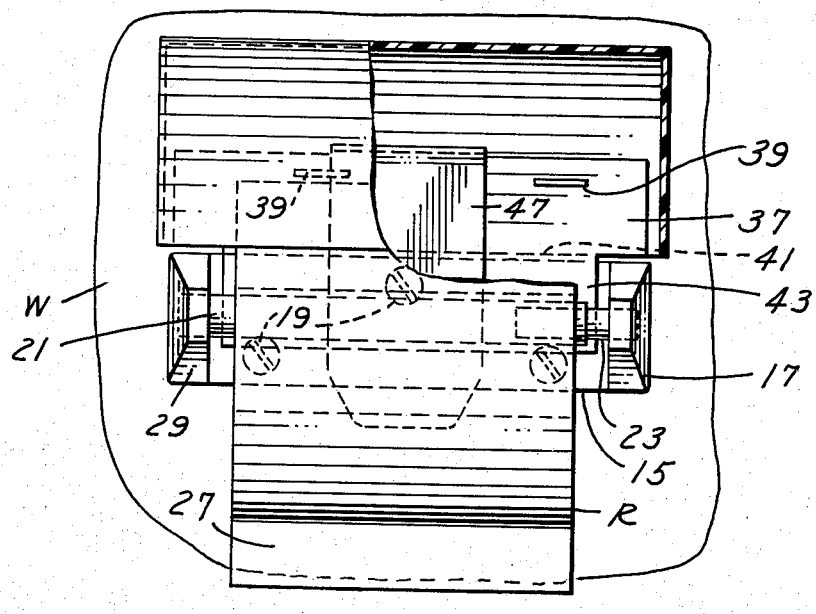
FIG. 3 is a front elevational view thereof, partly in section.

Referring to the drawing, conventional type of toilet paper dispenser is generally indicated at 11 as having a bracket 13 which includes a base 15 and at the ends thereof a pair of opposed trunnion arms 17. Often times the bracket is of a plastic material and is secured to the wall W by a plurality of fasteners such as the screws 19, shown in FIGS. 1 and 3.

A conventional roll holding dowel 21 is shown interposed between the outer end portions of the respective trunnions with its ends respectively nested within opposed recesses 29 within said trunnions in a conventional manner. As is characteristic of many dowels of this type, at one end thereof there is a retractable spring biased center 23 which yieldably nests within one of the trunnion recesses to provide a means of conveniently removing the dowel from the trunnion arms normally to facilitate assembly thereon or removal therefrom of a paper roll R in a conventional manner.

The roll in the present case includes a cylindrical core 25 which is loosely mounted upon said dowel and thus free for rotation thereof including the lead sheet 27 which projects from the windings of tissue upon and forming a part of said roll. The present improvement contemplates in combination with such toilet paper dispenser of a biasing means for restraining unwinding of the roll by direct engagement with the roll itself. The present biasing means is in the nature of a cover 31 or hood, generally semi-cylindrical in shape which has an arcuate top wall 33, front and rear edges and a pair of upright spaced end walls 35.

The cover or hood projects outwardly from the wall W, overlies and partly encloses the roll R.

The biasing means includes a resilient mounting for the cover or the hood which is in the form of an elongated mount strip 37, preferably constructed of a corrugated plastic, but resilient material. In the illustrative embodiment, the mount strip at its upper portion overlies the interior rear edge portion of the arcuate wall 33 and is secured thereto as by a pair of fasteners such as staples 39. Any other suitable fastening means may be employed such as adhesive for illustration.

Intermediate the top and bottom of the mount strip there is a crease 41 or scoring defining therebelow an elongated hinge strip 43 with said strip suitably secured to the wall, and indirectly in the illustrative embodiment secured by adhesive 45 to a portion of the bracket base 15. Any other type of conventional fastening means may be employed for anchoring the hinge strip to the wall W or to the base 15.

Figure 2:
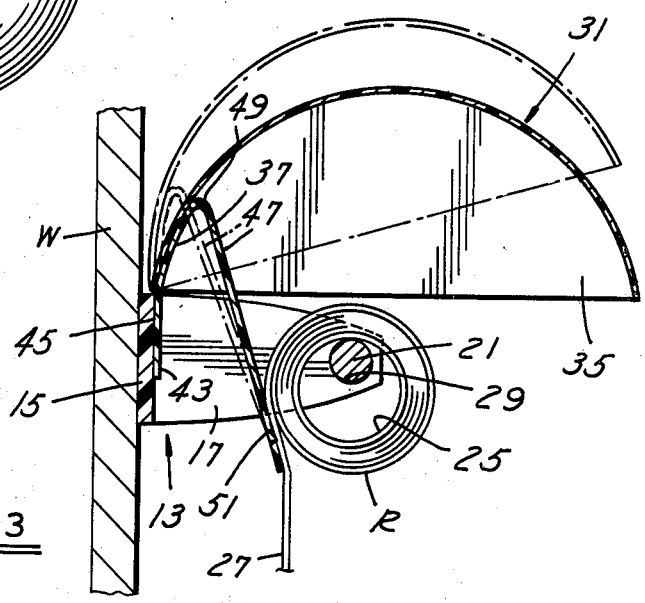
FIG. 2 is a vertical section thereof showing the roll partly unwound.

The mount strip at its upper edge has a further fold line or hinge 49 which defines the elongated friction tab 47 which extends downwardly and forwardly, as shown in FIG. 2. Said friction tab is adapted to operatively and yieldingly bear against roll R tangentially thereof as well as against the depending lead sheet 27 for the purpose of restraining free unwinding movements of the roll and thereby permitting a controlled unwinding thereof.

The tab 47 is resiliently connected to mount strip 37 and due to this resiliency is at all times biased against the outer surface of the roll R during unwinding thereof and as the roll becomes gradually reduced in diameter, such as shown in FIG. 2. The construction of the tab as associated with the mount strip is of such resiliency that the tab at all times is biased against the roll R tangentially thereto at 51 to provide controlled unwinding of the roll, FIG. 2.

Figure 1:
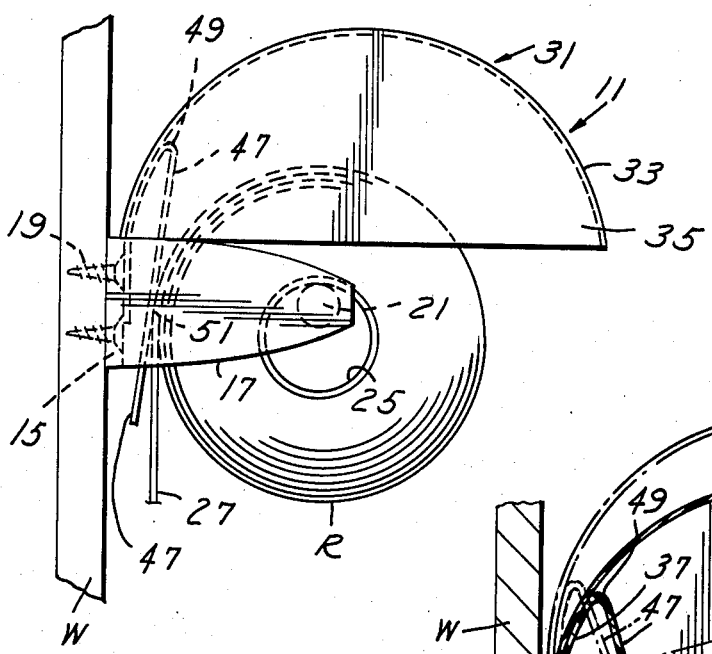
FIG. 1 is a side elevational view of the biasing means for restraining unwinding of a roll of toilet paper mounted upon a wall, fragmentarily shown by a conventional dispenser.

The present cover or hood 31 may be constructed of plastic or of stiff paper, for example, and as initially assembled, will have its lower edge substantially horizontally disposed, FIG. 1, so as to enclose merely the upper portion of the roll of tissue.

As the roll is reduced in diameter due to continued use, and with the tab being continually biased against its outer surface, as the roll unwinds, the hood or cover will gradually move upwardly such as to the dash line position shown in FIG. 2. This has the advantage of facilitating the disassembly of the used roll of toilet paper, the insertion of a new roll, such as shown in FIG. 1.

Having described my invention, reference should now be had to the following claims.

I claim:

1. In combination with a toilet paper dispenser including a bracket having a base mountable upon a wall and a pair of opposed trunnion arms at the ends of said base with opposed sockets, and a dowel at its ends removably mounted within said sockets supporting and loosely journaling a roll of toilet paper having a depending lead sheet;

a biasing means for restraining unwinding of said roll including a cover projecting from said wall, overlying and partly enclosing said roll, and having front and rear edges;

an elongated mount strip of resilient material secured upon said cover at its rear edge;

an elongated hinge strip flexibly connected to and depending from said mount strip and secured to said wall;

and a friction tab on and flexibly and resiliently connected to said mount strip extending angularly and forwardly downward thereof and adapted to tangentially and yieldably engage said roll, retaining said roll and lead strip for limited and controlled unwinding movements.

2. In the dispenser of claim 1, said cover being in the form of a downwardly opening hood.

3. In the dispenser of claim 2, said hood being substantially semicylindrical in shape, having an arcuate top wall and a pair of spaced upright end walls.

4. In the dispenser of claim 3, said mount strip being secured to said top wall.

5. In the dispenser of claim 4, said friction tab extending from the top of said mount strip.

6. In the dispenser of claim 1, said mount strip being scored at its top and adjacent its bottom and forming hinged connections for said tab and hinge strip respectively.

7. In the dispenser of claim 1, said tab being yieldably biased into continuous engagement with said roll till it is fully unwound.

8. In the dispenser of claim 1, said mount strip being stapled to said cover.

9. In the dispenser of claim 1, said hinge strip being adhesively secured to said base.

10. In the dispenser of claim 1, said hinge strip being mounted upon said bracket base.

11. In the dispenser of claim 1, said mount strip, hinge strip and tab being unitary and formed of a corrugated plastic sheet.

* * * * *